United States Patent [19]

Sokaris

[11] Patent Number: 4,943,476

[45] Date of Patent: Jul. 24, 1990

[54] WATER REMOVAL ON PAPERMACHINE THROUGH RIBLET EFFECT

[75] Inventor: Jerry G. Sokaris, Troy, N.Y.

[73] Assignee: Albany International Corp., Menands, N.Y.

[21] Appl. No.: 263,592

[22] Filed: Oct. 27, 1988

[51] Int. Cl.[5] ..... D04H 1/08

[52] U.S. Cl. ..... 428/280; 162/DIG. 1; 428/234; 428/300; 428/364; 428/400

[58] Field of Search ..... 428/234, 280, 300, 364, 428/400; 162/DIG. 1

[56] References Cited

U.S. PATENT DOCUMENTS 4,283,454 8/1981 Buchanan ..... 428/234

4,382,987 5/1983 Smart ..... 428/234

*Primary Examiner*—James J. Bell

*Attorney, Agent, or Firm*—Kane, Dalsimer, Sullivan, Kurucz, Levy, Eisele & Richard

[57] ABSTRACT

This invention involves an application of the so-called "riblet" effect to the fabrics used on machines in the papermaking industry. The "riblet" effect itself is a reduction in the measured frictional drag on a surface that is moving relative to a fluid when microscopic grooves are machined on a surface in a direction parallel to that of the motion. Here, this finding is applied to the fibers, filaments, and monofilaments used in the weaving of papermakers fabrics, and to the fibers used to form batts which are needled into the structure of base fabrics, as a way to enhance their water-removing abilities.

8 Claims, 1 Drawing Sheet

FIG. 1
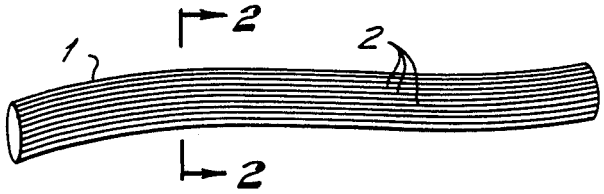
FIG. 2
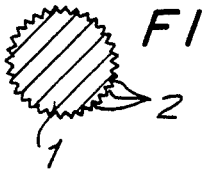
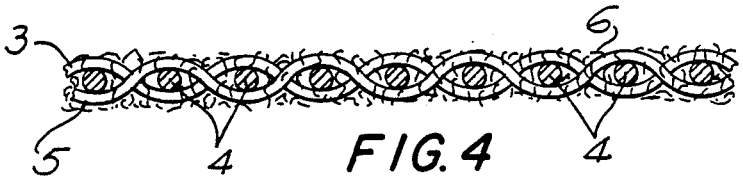
FIG. 4
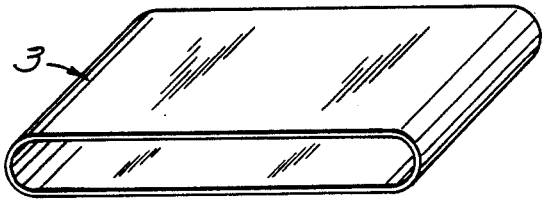
FIG. 3

WATER REMOVAL ON PAPERMACHINE THROUGH RIBLET EFFECT

BACKGROUND OF THE INVENTION

1. Field of the Invention

This invention relates to the machine fabrics or felts used in the papermaking industry to support, carry and remove water from the wet fibrous sheet being processed into paper. Specifically, it involves the incorporation in such a felt of fibers, filaments, or monofilaments, which are extruded in such a way that microscopic grooves or riblets run along their lengths.

2. Description of the Prior Act

The papermaking industry is continuously in search of new ways to increase paper production rates without increasing plant overhead. Contrary to what one might expect, this cannot be accomplished simply by speeding up the papermachine, because its components, particularly those in the press section, have inherently limited abilities to remove water from the wet fibrous sheet being processed into a paper product. For a given machine configuration, that is, a given felt, press, and compression setting, water-removal efficiency will decrease with increased machine speed. In addition, and more importantly, the likelihood of damage to the sheet during production will increase with machine speed, if adjustments or modifications to the machine do not accompany this increase, because compression values will be forced up by water unable to drain any faster from the felt.

No matter what the speed of the machine, however, there will always be large quantities of water remaining in the sheet at the end of its passage through the press section. At that point, in fact, the sheet is typically about 50% water. This water must be removed in the final part of the papermachine, the dryer section. There, the sheet is conducted around a series of steam-heated rolls, which evaporate the remaining water. Costs associated with the production of this heat can cut deeply into potential profits. Because of rising energy costs, a slight improvement in water-removal efficiency in the press section, even on the order of a few percent, can yield tremendous savings and, as a result, lead to greater profits. This potential for greater profits provides the impetus for continued research in the area of water removal.

This research proceeds on two broad fronts, directed toward improving either press or machine felt design. In a conventional papermachine press, water is removed from the wet fibrous sheet by passing it, in conjunction with the machine felt, or felts, through the narrow space between adjacent paired press rolls. Each narrow space, referred to as the nip, is the location at which the sheet and felt are pressed together, squeezing water from the sheet and into the felt. The nip, however, is of rather short length, and, therefore, a given incremental length of the sheet receives its compressive influence for only a relatively short time, referred to as the dwell time.

Some improvements in press design have involved attempts to broaden the nip and thereby indirectly extend the dwell time. One method has been to cover the surfaces of the rolls with a compressible, elastic material. The slight flattening of the roll surfaces that will then occur in their contact area effectively broadens the nip. Another method has been to replace one of the rolls of a two-roll press with a stationary shoe, whose operation is similar in concept to that of a brake shoe being forced against the outer circumference of a wheel. In this case, a gap is maintained between the surfaces of the shoe and the spinning roll. This gap functions as a much broader nip than could be realized in any two-roll press. Hence, this arrangement is referred to as the extended nip press.

Other commonly seen press modifications, not directed toward extending dwell time, involve grooved or drilled press rolls, whose surfaces have been provided with holes or grooves to serve as channels for water to follow rather than rewet the felt and sheet upon exit from the nip. Suction presses, also incorporating drilled press rolls, have the added feature of suction from within the roll to draw water away from the felt and sheet in the nip.

All of these press designs operate in conjunction with the machine felts clothing them. These felts are continually being modified and improved, and new ways of improving their water-handling abilities are constantly being sought.

Up until fairly recently, wool was the primary component of press felt. Indeed, the term "felt" was literally applicable to these fabrics because, in one of the final steps of their manufacture, the woven wool material was wetted and rubbed in such a way to produce a felt having a smooth surface. Wool has largely passed from this usage, however, for a number of reasons. Among them are its susceptibility to chemical and bacterial attack, and its lack of durability at high press speeds.

The synthetic fabrics used today instead of wool are, for the most part, free of these disadvantages. While the term "felt" is no longer literally applicable to the machine clothing made from synthetics, its use is common, if not universal, in the papermaking industry. The increased strength and durability of synthetics allow such felts to be used at much higher machine speeds for longer time periods than those made of wool. Their resistance to chemicals allows them to be cleaned more effectively. Finally, new weaving techniques and felt designs incorporating synthetics and including voids for holding water within multiple layered fabrics to assist in water removal have been developed, which would not have been feasible with wool.

At first, synthetic content in press felts remained at about 30% because such fibers could not be felted or matted in accordance with traditional felting processes. The advent of the needled felt made mechanical felting possible, and synthetic content was gradually increased. Today, there are felts produced completely from synthetics.

The so-called needled felt referred to above is composed of two basic parts: the base fabric and the batt. The base fabric is commonly woven and contains both machine-direction and cross-machine direction yarns. Depending on the requirements of a given machine application, the base fabric could be woven from either monofilament or multifilament yarn or from a combination of both in either a single- or multi-layered structure.

The batt, a layer of carded fibers, is then needled into the base fabric. Carding is the process whereby tangled fibers are combed out so they are aligned more or less parallel to each other. The batt is laid on the base just before passing through a needling machine. The needles are equipped with tiny barbs facing toward the needle point, and are fastened to a vertically reciprocating plate. As they descend, the barbs grasp a few batt fibers and force them into the base fabric. The fibers are thus locked into the body of the base fabric and are partly oriented perpendicularly to the plane of the fabric. Each square inch of base fabric may be subjected to more than 2,500 needle penetrations.

While the surface of a needled felt bears a resemblance to that of conventional felts, the needled felt is a substantial advance over them because during needling the batt fibers become more or less vertically oriented. As a consequence, flow resistance in the vertical direction through the felt is much lower than that in a conventional felt.

One recent advance which has found application is one which has come to be referred to as the "riblet" effect.

The "riblet" effect addresses the frictional drag or resistance experienced by an object in motion relative to some fluid medium. This friction arises from turbulence present along the surfaces of an object in such a situation, and can contribute to energy losses.

In searching for ways to reduce this turbulence, it was found that microscopic, parallel grooves, cut into the surface in a direction parallel to that of its motion, will significantly reduce it and lower the resultant frictional drag. While to a great extent these findings are empirical and result from practical experimentation, reductions in surface drag on the order of a few percent have been measured. The characteristics so determined for the optimum "riblets", when the fluid is air, are that they be V-shaped grooves, having a 1:1 height-to-spacing ratio, a depth of a few thousandths of an inch.

A lowered frictional drag can be viewed alternatively in terms of a surface which is more slippery with respect to the fluid. The proper application of "riblet" technology to the papermaking industry could lead to significantly improved water removal in papermachine press sections, and to lowered fuel costs in the dryer section.

SUMMARY OF THE INVENTION

The present invention incorporates "riblet" effect into papermachine fabrics or felts as a way to improve the efficiency with which they conduct water way from the wet fibrous sheet being processed into paper. The anticipated goals of the invention are to save the paper producer a significant amount in drying costs, because the sheet will be drier when leaving the press section, and to permit higher production rates.

This is accomplished by using, in the weaving of the machine felts, and in the batts needled thereon, fibers, filaments, or monofilaments, extruded from dies which would leave tiny grooves, the "riblets", running lengthwise along their surfaces. The presence of these grooves lowers the turbulence in water that flows lengthwise along these threads, thereby reducing the surface friction or drag experienced by the water. The "riblets" need only have a depth on the order of a few thousandths of an inch to produce the desired effect. As a consequence, the felt has an improved ability to carry water away from the sheet and allows improved sheet dewatering. A drier sheet, containing less water to be evaporated in the dryer section, will then exit from the press section.

In order to clarify the appended claims, it is necessary to define a few terms, already used above, as they are used in the papermachine felt industry. Proceeding in order of increasing size, fibers are the extremely fine, relatively short thread-like components used to spin yarn and as batt material. Filaments, somewhat thicker and longer than fibers, are either twisted or braided together to form multifilaments. Monofilaments, thicker still than filaments, are used alone, that is, not braided or twisted together. Frequently, yarn will be coated and impregnated with a plastic or polymer material. This yields a product resembling filament or monofilament, depending on thickness. In any case, yarn, multifilament, and monofilament are the constituents used to weave the base fabrics in papermachine clothing.

BRIEF DESCRIPTION OF THE DRAWINGS

FIG. 1 shows a length of monofilament whose surface has been given the grooves or "riblets" of this invention.

FIG. 2 shows a cross-section of the same length of monofilament and provides a clearer view of the grooves.

FIG. 3 illustrates the general appearance of a press felt in which this invention may be incorporated from a perspective view.

FIG. 4 is a cross-sectional view of a needled felt which includes a batt composed of fibers grooved in accordance with this invention. Features common to any figures have been given the same identifying numerals.

DESCRIPTION OF THE PREFERRED EMBODIMENT

FIG. 1 shows an enlarged view of a length of monofilament 1, which has been produced or treated in a manner that has left microscopic grooves 2 running lengthwise along its surface. This can most conveniently be accomplished during the extrusion of the monofilament 1 during production using a die with an appropriately notched orifice. As shown in the figure, the entire surface of the monofilament 1 has been so grooved, but this does not absolutely have to be the case. The grooves 2 as shown are evenly spaced, of a uniform depth, and essentially parallel to one another and to the length of the monofilament 1. The depth of the grooves 2, on the order of a few thousandths of an inch, is much less than the diameter of the monofilament 1.

In general, the appropriate depth for the grooves will vary with the diameter of the fiber, filament, or monofilament of interest. At the fine end of the size spectrum, as previously noted, are the fibers, whose diameters are of the order of a few thousandths of an inch. The appropriate riblet depth for fibers falls in the range between one ten-thousandth and one hundred-thousandth of an inch, which is much less than the diameter of the fiber itself.

At the thick end of the size spectrum are monofilaments, whose diameters typically fall in the range from eight (8) to twenty (20) thousandths of an inch. The appropriate riblet depth would be on the order of a few thousandths of an inch, for example, one or two thousandths of an inch.

Filaments of diameter between these extremes would be given grooves of a depth between those specified above for fibers and monofilaments.

FIG. 2 is a cross-section of the monofilament 1 taken at the point indicated in FIG. 1. The exact nature of the structure and spacing of the grooves 2 is more clearly shown in FIG. 2. "V"-shaped grooves 2 having a spacing approximately equal to their depth are depicted. The exact shape of the grooves 2, however, as well as the relationship between spacing and depth, can be varied.

FIG. 3 shows a press felt which takes the form of a continuous, closed belt.

FIG. 4 shows a cross-sectional view of part of a needled felt comprising a base fabric 3 woven from machine-direction yarns 4 and cross-machine direction yarns 5 with a batt of fibers 6 forced perpendicularly into the plane of the base fabric 3. All these components can be given "riblets" in accordance with this invention to improve the water removal qualities of this felt.

Modifications would be obvious to one skilled in the art without departing from the scope of the invention as defined in the appended claims.

What is claimed is:

1. A papermaker's felt for use in the wet press section of a papermachine comprising yarn whose surface is characterized by a plurality of lengthwise grooves.

2. A papermaker's felt as in claim 1 wherein said yarn is a monofilament.

3. A papermaker's felt as in claim 1 wherein said yarn is spun from fibers and encapsulated in a coating material.

4. A papermaker's felt for use in the wet press section of a papermachine comprising yarn spun from fibers whose surfaces are characterized by a plurality of lengthwise grooves.

5. A papermaker's felt for use in the wet press section of a papermachine comprising filaments whose surfaces are characterized by a plurality of lengthwise grooves.

6. A papermaker's felt for use in the wet press section of a papermachine comprising a batt of fibers needled into the structure of said felt, said fibers having surfaces characterized by a plurality of lengthwise grooves.

7. A papermaker's felt for use in the wet press section of a papermachine comprising 100% or less of yarns, filaments, monofilament fibers whose surface is characterized by a plurality of lengthwise grooves.

8. In a papermaker's fabric for use on a papermachine to support, carry, and dewater a wet fibrous sheet being processed into paper, said papermaker's fabrics including yarns, the improvement comprising yarns whose surfaces bear a plurality of longitudinal grooves.

* * * * *